US009136623B2

(12) United States Patent
Hamada et al.

(10) Patent No.: US 9,136,623 B2
(45) Date of Patent: Sep. 15, 2015

(54) CONNECTOR

(75) Inventors: Keiji Hamada, Shizuoka (JP); Takumi Nakagishi, Shizuoka (JP); Keigo Tsubo, Shizuoka (JP); Kazuhiro Fujino, Tokyo (JP); Ryusuke Murayama, Tokyo (JP)

(73) Assignee: YAZAKI CORPORATION, Tokyo (JP)

( * ) Notice: Subject to any disclaimer, the term of this patent is extended or adjusted under 35 U.S.C. 154(b) by 153 days.

(21) Appl. No.: 13/819,786

(22) PCT Filed: Aug. 26, 2011

(86) PCT No.: PCT/JP2011/069318

§ 371 (c)(1),
(2), (4) Date: Aug. 26, 2013

(87) PCT Pub. No.: WO2012/029660

PCT Pub. Date: Mar. 8, 2012

(65) Prior Publication Data

US 2013/0323944 A1 Dec. 5, 2013

(30) Foreign Application Priority Data

Sep. 3, 2010 (JP) ..... 2010-198068

(51) Int. Cl.
*H01R 12/71* (2011.01)
*H01R 12/72* (2011.01)
(Continued)

(52) U.S. Cl.
CPC ..... *H01R 12/71* (2013.01); *H01R 12/57* (2013.01); *H01R 12/724* (2013.01); *H01R 12/7011* (2013.01)

(58) Field of Classification Search
CPC ..... H01R 13/6471
USPC ..... 439/79, 607.35–607.4
See application file for complete search history.

(56) References Cited

U.S. PATENT DOCUMENTS 5,186,633 A * 2/1993 Mosser, III ..... 439/79
6,250,957 B1 * 6/2001 Chang ..... 439/541.5
(Continued)

FOREIGN PATENT DOCUMENTS

CN 1848531 A 10/2006
CN 101364694 A 2/2009
(Continued)

OTHER PUBLICATIONS

International Search Report dated Sep. 27, 2011 for International application No. PCT/JP2011/069318.
(Continued)

*Primary Examiner* — Ross Gushi
(74) *Attorney, Agent, or Firm* — Morgan, Lewis & Bockius LLP

(57) ABSTRACT

A connector includes a housing and terminal fittings attached to a printed circuit board. The terminal fittings form two terminal rows. In the terminal rows, one end parts of the terminal fittings are piled in a fitting plate part of the housing to which a mate side connector is fitted in a mutually parallel state and arranged in parallel with a surface of the printed circuit board. Central parts of the terminal fittings are bent. The other end parts are connected to a conductor pattern of the printed circuit board. In the other end parts of the terminal fittings, outward bent parts are provided which are bent outward in the direction of width of the housing. Tip ends of the other end parts of all the terminal fittings are arranged with spaces left between them along the direction of width of the housing.

5 Claims, 5 Drawing Sheets

(51) Int. Cl.
*H01R 12/57* (2011.01)
*H01R 12/70* (2011.01)

(56) References Cited

U.S. PATENT DOCUMENTS

| | | | | |
|---|---|---|---|---|
| 6,986,681 | B2 * | 1/2006 | Tsai | 439/607.36 |
| 7,210,945 | B1 * | 5/2007 | Ying | 439/79 |
| 7,270,571 | B1 * | 9/2007 | Huang et al. | 439/607.45 |
| 7,303,410 | B2 * | 12/2007 | Saito | 439/108 |
| 7,318,752 | B2 * | 1/2008 | Fujimoto et al. | 439/660 |
| 7,413,467 | B1 * | 8/2008 | Lai et al. | 439/489 |
| 7,435,107 | B2 * | 10/2008 | Masumoto et al. | 439/79 |
| 7,445,469 | B2 * | 11/2008 | Wu | 439/79 |
| 7,485,008 | B1 * | 2/2009 | Yi et al. | 439/660 |
| 7,575,454 | B1 * | 8/2009 | Aoki et al. | 439/188 |
| 7,611,387 | B1 * | 11/2009 | Zhang | 439/660 |
| 7,632,111 | B2 * | 12/2009 | Xiong et al. | 439/79 |
| 7,674,118 | B2 * | 3/2010 | He | 439/108 |
| 7,682,163 | B2 * | 3/2010 | Hou et al. | 439/79 |
| 7,727,027 | B2 * | 6/2010 | Chiang et al. | 439/660 |
| 7,748,999 | B1 * | 7/2010 | Sun et al. | 439/79 |
| 7,753,724 | B2 * | 7/2010 | Gong et al. | 439/541.5 |
| 7,824,220 | B2 * | 11/2010 | Chen | 439/607.35 |
| 7,845,982 | B1 * | 12/2010 | Wang | 439/607.25 |
| 7,857,665 | B2 * | 12/2010 | Xiong et al. | 439/660 |
| 7,862,378 | B1 * | 1/2011 | Wan et al. | 439/607.35 |
| 7,909,653 | B1 * | 3/2011 | Wan et al. | 439/660 |
| 7,942,704 | B2 * | 5/2011 | Ko et al. | 439/660 |
| 7,972,151 | B2 * | 7/2011 | He et al. | 439/108 |
| 7,988,495 | B2 * | 8/2011 | Chung | 439/660 |
| 8,070,525 | B2 * | 12/2011 | Hou et al. | 439/660 |
| 8,070,529 | B2 * | 12/2011 | Xiong et al. | 439/676 |
| 8,142,209 | B2 * | 3/2012 | Zhu et al. | 439/108 |
| 8,172,620 | B2 * | 5/2012 | Su et al. | 439/660 |
| 8,202,120 | B2 * | 6/2012 | Ko | 439/607.35 |
| 8,206,177 | B2 * | 6/2012 | Chang | 439/607.35 |
| 8,210,878 | B2 * | 7/2012 | Shirai et al. | 439/620.21 |
| 8,246,387 | B2 * | 8/2012 | Fjelstad | 439/638 |
| 8,262,414 | B1 * | 9/2012 | Li et al. | 439/607.35 |
| 8,292,671 | B2 * | 10/2012 | Chung | 439/660 |
| 8,333,614 | B2 * | 12/2012 | Xiong et al. | 439/660 |
| 8,568,172 | B1 * | 10/2013 | Lan et al. | 439/607.4 |
| 8,591,272 | B2 * | 11/2013 | Shiratori et al. | 439/885 |
| 8,662,936 | B2 * | 3/2014 | Chung et al. | 439/660 |
| 8,777,672 | B2 * | 7/2014 | Chung et al. | 439/660 |
| 8,790,138 | B2 * | 7/2014 | Wang et al. | 439/660 |
| 8,851,928 | B2 * | 10/2014 | He | 439/607.37 |
| 8,851,930 | B2 * | 10/2014 | Peng | 439/660 |
| 8,864,501 | B2 * | 10/2014 | Lin et al. | 439/79 |
| 8,882,515 | B2 * | 11/2014 | Lv et al. | 439/79 |
| 8,882,540 | B2 * | 11/2014 | Yen et al. | 439/607.27 |
| 8,894,451 | B2 * | 11/2014 | Shiratori et al. | 439/885 |
| 2004/0235350 | A1 * | 11/2004 | Fang | 439/607 |
| 2004/0248472 | A1 * | 12/2004 | Aso et al. | 439/660 |
| 2005/0186843 | A1 * | 8/2005 | Tsai | 439/607 |
| 2005/0272286 | A1 * | 12/2005 | Lapidot et al. | 439/108 |
| 2006/0234529 | A1 | 10/2006 | Yamagami et al. | |
| 2007/0066115 | A1 * | 3/2007 | Saito et al. | 439/260 |
| 2007/0111564 | A1 * | 5/2007 | Ying | 439/79 |
| 2007/0149058 | A1 * | 6/2007 | Saito | 439/608 |
| 2009/0017646 | A1 | 1/2009 | Nagata et al. | |
| 2009/0042421 | A1 | 2/2009 | Zheng et al. | |
| 2009/0042450 | A1 | 2/2009 | Zheng et al. | |
| 2009/0130873 | A1 * | 5/2009 | He | 439/108 |
| 2009/0186528 | A1 * | 7/2009 | Chen | 439/660 |
| 2009/0203261 | A1 * | 8/2009 | Ikegami et al. | 439/628 |
| 2009/0280663 | A1 * | 11/2009 | Yuan et al. | 439/79 |
| 2009/0298336 | A1 * | 12/2009 | Xiong et al. | 439/607.01 |
| 2009/0298351 | A1 * | 12/2009 | Xiong et al. | 439/676 |
| 2010/0022138 | A1 | 1/2010 | Miyoshi et al. | |
| 2010/0068903 | A1 * | 3/2010 | Chiang et al. | 439/79 |
| 2010/0173524 | A1 * | 7/2010 | Zhu et al. | 439/607.01 |
| 2010/0173529 | A1 * | 7/2010 | He et al. | 439/660 |
| 2011/0034078 | A1 * | 2/2011 | Nagata et al. | 439/607.01 |
| 2011/0034079 | A1 * | 2/2011 | Nagata et al. | 439/607.01 |
| 2011/0039447 | A1 * | 2/2011 | Lai et al. | 439/527 |
| 2011/0104915 | A1 * | 5/2011 | Lin et al. | 439/108 |
| 2011/0130014 | A1 * | 6/2011 | Zhu et al. | 439/78 |
| 2011/0130046 | A1 * | 6/2011 | Su et al. | 439/660 |
| 2011/0269322 | A1 * | 11/2011 | He et al. | 439/78 |
| 2011/0269341 | A1 * | 11/2011 | He et al. | 439/607.01 |
| 2011/0269343 | A1 * | 11/2011 | Chen | 439/626 |
| 2011/0281446 | A1 * | 11/2011 | Yu et al. | 439/92 |
| 2012/0225583 | A1 * | 9/2012 | Kamarauskas et al. | 439/607.01 |
| 2012/0231675 | A1 * | 9/2012 | Zhang | 439/682 |
| 2012/0276777 | A1 * | 11/2012 | Lv et al. | 439/607.01 |
| 2013/0090022 | A1 * | 4/2013 | Shiratori et al. | 439/692 |
| 2013/0130546 | A1 * | 5/2013 | Wu et al. | 439/604 |
| 2013/0323944 | A1 * | 12/2013 | Hamada et al. | 439/65 |
| 2013/0344739 | A1 * | 12/2013 | Shih | 439/607.28 |

FOREIGN PATENT DOCUMENTS

| | | | |
|---|---|---|---|
| EP | 1 030 410 | | 8/2000 |
| JP | 4-085682 | U | 7/1992 |
| JP | H07-161414 | A | 6/1995 |
| JP | 2000-243520 | | 9/2000 |
| JP | 2003-229214 | A | 8/2003 |
| JP | 2007-179960 | | 7/2007 |
| JP | 3134262 | U | 7/2007 |
| JP | 3145209 | U | 10/2008 |
| JP | 2009-009728 | A | 1/2009 |
| JP | 2009-21152 | | 1/2009 |
| JP | 2009-43717 | | 2/2009 |
| JP | 3150862 | U | 5/2009 |
| JP | 2010-27456 | | 2/2010 |
| JP | 2010-157505 | A | 7/2010 |

OTHER PUBLICATIONS

Japanese Office Action dated Jul. 25, 2014 for corresponding Japanese Patent Application No. 2010-198068.

Extended European Search Report dated Dec. 12, 2013 for corresponding Application No. 11821677.9.

Japanese Office Action dated Oct. 7, 2014, issued by the Japanese Patent Office in Japanese Patent Application No. 2010-198068.

Chinese Office Action dated Sep. 29, 2014, for corresponding Chinese Patent Application No. 201180042599.X.

Notification of the Second Office Action dated May 27, 2015 from The State Intellectual Property Office of the People's Republic of China in counterpart Chinese Patent Application No. 201180042599.X.

* cited by examiner

CONNECTOR

TECHNICAL FIELD

The present invention relates to a connector fixed to a printed circuit board.

BACKGROUND ART

In a connector (for instance, patent literature 1) mounted on a printed circuit board, a housing is fixed to the printed circuit board and a terminal fitting attached to the housing is fixed on the printed circuit board by soldering. The terminal fitting has one end part located in the housing and arranged in parallel with a surface of the printed circuit board so as to be spaced from each other. The terminal fitting has a central part passing through the housing and bent substantially at 90° to the printed circuit board. The terminal fitting has the other end part fixed to a conductor pattern of the printed circuit board by solder.

LITERATURE OF RELATED ART

Patent Literature

Patent Literature 1: JP-A-2007-179960
Patent Literature 2: JP-A-2009-21152
Patent Literature 3: JP-A-2010-27456

SUMMARY OF THE INVENTION

Problems that the Invention is to Solve

In the connector shown in the above-described patent literature 1 to patent literature 3, since the central part of the terminal fitting is merely bent substantially 90° to the printed circuit board, spaces between the one end parts of the mutually adjacent terminal fittings of the terminal fittings are respectively equal to spaces between the other end parts of the mutually adjacent terminal fittings.

While the one end parts of the terminal fittings enter an insulating housing of a connector of a mate side fitted to the housing, the other end parts of the terminal fittings are exposed on the surface of the printed circuit board. In order to prevent the terminal fittings from being mutually short-circuited, the spaces between the other end parts of the terminal fittings cannot be made to be narrower than prescribed spaces. Accordingly, the spaces between the one end parts of the terminal fittings cannot be made to be narrower than the above-described prescribed spaces. Thus, in the connector disclosed in the patent literature 1 to the patent literature 3, the housing (namely, the connector) is hardly miniaturized.

Further, in the connector disclosed in the patent literature 1 to the patent literature 3, a plurality of rows of terminal fittings are provided with prescribed spaces left in the direction of thickness of the printed circuit board. Accordingly, in the connector disclosed in the patent literature 1 to the patent literature 3, the other end parts of the plurality of the terminal fittings are arranged in the longitudinal direction of the one end parts of the terminal fittings. A problem arises that the other end parts of the terminal fittings located near the housing are especially hardly attached to the conductor pattern of the printed circuit board by the solder.

Accordingly, it is an object of the present invention to provide a connector attached to a printed circuit board which can be miniaturized and easily attached to the printed circuit board.

Means for Solving the Problems

The above-described object of the present invention is achieved by below-described structures.

(1) A connector including a housing attached to a printed circuit board and a terminal fitting row having a plurality of terminal fittings whose one end parts are piled in a fitted part of the housing to which a mate side connector is fitted in a mutually parallel state and arranged in parallel with a surface of the printed circuit board, whose central parts are bent and whose the other end parts are connected to a conductor pattern of the printed circuit board, wherein in the other end part of at least one terminal fitting of the plurality of terminal fittings in the terminal fitting rows, an outward bent part is provided which is bent outward in the direction of width of the housing and tip ends of the other end parts of the plurality of terminal fittings are arranged with spaces left between them along the direction of width of the housing.

(2) In the connector having the structure of the above-described (1), a plurality of terminal fitting rows are provided with spaces left between them in the direction intersecting the surface of the printed circuit board, and the outward bent parts are provided in the other end parts of the terminal fittings so that the tip ends of the other end parts of the terminal fittings in all the terminal fitting rows are arranged with spaces left between them along the direction of width of the housing.

(3) In the connector having the structure of the above-described (1), the two terminal fitting rows are provided with spaces left between them in the direction intersecting the surface of the printed circuit board, and the outward bent parts are provided in the other end parts of the terminal fittings so that the tip ends of the other end parts of the terminal fittings in the two terminal fitting rows are alternately arranged with spaces left between them along the direction of width of the housing.

(4) In the connector having the structure of the above-described (1), the outward bent parts of the terminal fittings located nearer to outer sides in the direction of width of the housing are provided nearer to the central parts of the terminal fittings than the outward bent parts of the terminal fittings located nearer to a central part in the direction of width of the housing among the plurality of terminal fittings in the terminal fitting rows.

(5) In the connector having the structure of the above-described (1), bending angles of the outward bent parts of the terminal fittings located nearer to outer sides in the direction of width of the housing are larger than bending angles of the outward bent parts of the terminal fittings located nearer to the central part in the direction of width of the housing among the plurality of terminal fittings in the terminal fitting rows.

According to the connector having the structure of the above-described (1), since in the other end part of at least one terminal fitting, the outward bent part is provided which is bent outward in the direction of width of the housing, spaces between the other end parts of the mutually adjacent terminal fittings can be made to be larger than spaces between the one end parts of the mutually adjacent terminal fittings. Namely, the spaces between the one end parts of the mutually adjacent terminal fittings can be made to be narrower than the spaces between the other end parts of the mutually adjacent terminal fittings. Accordingly, the width of the housing (namely, the connector itself) can be miniaturized.

Further, since the tip ends of the other end parts of the terminal fittings are arranged in the direction of width of the housing, the tip ends of the other end parts of the terminal fittings are not arranged along the longitudinal directions of the one end parts of the terminal fittings. Therefore, the tip ends of the other end parts of the terminal fittings can be easily connected to the conductor pattern of the printed circuit board by a solder. Accordingly, the connector can be miniaturized and easily attached to the printed circuit board.

According to the connector having the structure of the above-described (2), since the tip ends of the other end parts of the terminal fittings of all the terminal fitting rows are arranged in the direction of width of the housing, the tip ends of the other end parts of the terminal fittings are not arranged along the longitudinal directions of the one end parts of the terminal fittings. Therefore, the tip ends of the other end parts of the terminal fittings can be easily connected to the conductor pattern of the printed circuit board by the solder.

According to the connector having the structure of the above-described (3), since the tip ends of the other end parts of the terminal fittings of the two terminal fitting rows are arranged in the direction of width of the housing, the tip ends of the other end parts of the terminal fittings are not arranged along the longitudinal directions of the one end parts of the terminal fittings. Therefore, the tip ends of the other end parts of the terminal fittings can be easily connected to the conductor pattern of the printed circuit board by the solder.

According to the connector having the structure of the above-described (4), since the outward bent parts of the terminal fittings located nearer to the outer sides in the direction of width of the housing are provided nearer to the central parts of the terminal fittings than the outward bent parts of the terminal fittings located nearer to the central part of the housing, the tip ends of the other end parts of the terminal fittings located nearer to the outer sides are located more outward in the direction of width of the housing. Accordingly, the other end parts of the terminal fittings are not allowed to come into mutual contact and the spaces between the one end parts of the mutually adjacent terminal fittings can be made to be narrower than the spaces between the other end parts of the mutually adjacent terminal fittings. Accordingly, the width of the housing (namely, the connector itself) can be miniaturized.

According to the connector having the structure of the above-described (5), since the bending angles of the outward bent parts of the terminal fittings located nearer to the outer sides in the direction of width of the housing are larger than the bending angles of the outward bent parts of the terminal fittings located nearer to the central part of the housing, the tip ends of the other end parts of the terminal fittings located nearer to the outer sides are located more outward in the direction of width of the housing. Accordingly, the other end parts of the terminal fittings are not allowed to come into mutual contact and the spaces between the one end parts of the mutually adjacent terminal fittings can be made to be narrower than the spaces between the other end parts of the mutually adjacent terminal fittings. Accordingly, the width of the housing (namely, the connector itself) can be miniaturized.

MODE FOR CARRYING OUT THE INVENTION

Figure 1:
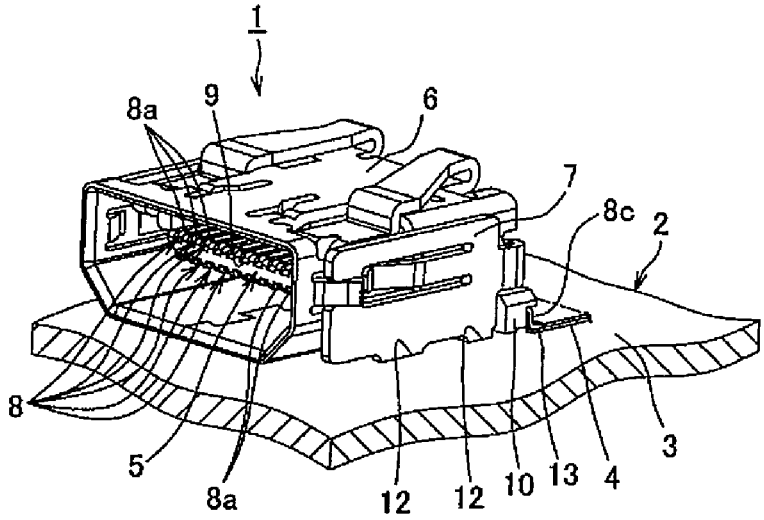
FIG. 1 is a perspective view of a connector according to one exemplary embodiment of the present invention.

Now, a connector according to one exemplary embodiment of the present invention will be described below by referring to FIG. 1 to FIG. 6. The connector 1 according to the one exemplary embodiment of the present invention is used to transmit a high speed digital signal, attached to a printed circuit board 2 and fitted to a connector of a mate side. As shown in FIG. 1, the printed circuit board 2 includes an insulating substrate 3 and an electrically conductive conductor pattern 4 provided in a prescribed pattern on the surface of the substrate 3.

Figure 2:
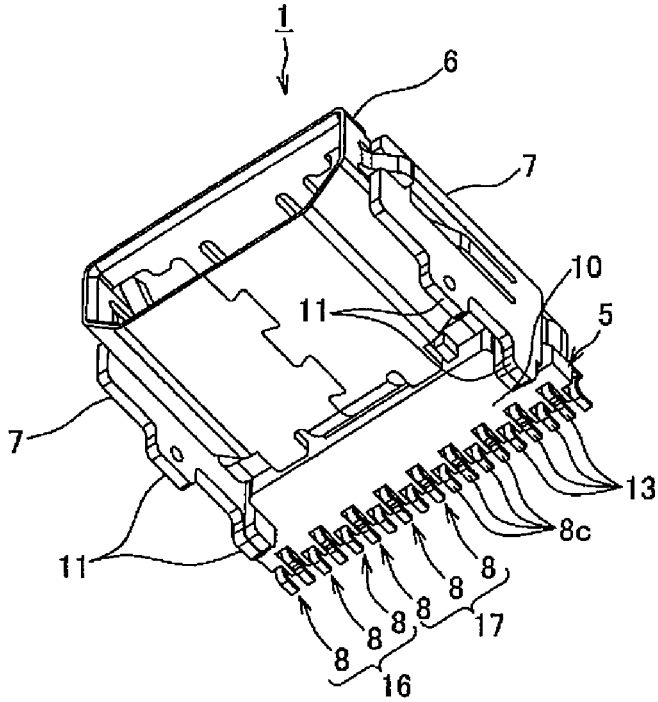
FIG. 2 is a perspective view of the connector shown in FIG. 1 which is seen from a lower part.
Figure 3:
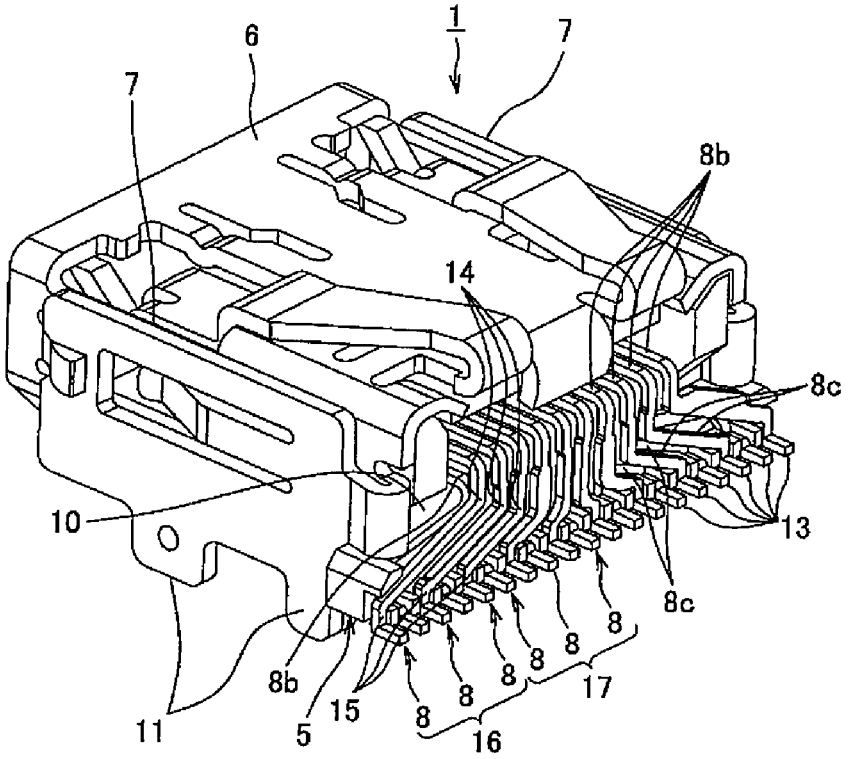
FIG. 3 is a perspective view of the connector shown in FIG. 1 which is seen from a rear part.

As shown in FIG. 1, FIG. 2 and FIG. 3, the connector 1 includes a housing 5, a shield shell 6, fixing members 7 and a plurality of terminal fittings 8.

The housing 5 is formed with an insulating synthetic resin. As shown in FIG. 1, the housing 5 includes integrally a fitting plate part 9 as a fitted part and a partition wall part 10 (shown in FIG. 3) and is formed to be flat. The fitting plate part 9 is formed in the shape of a flat plate. On both surfaces of the fitting plate part 9, below-described one end parts 8*a* of terminal fittings 8 are piled under a mutually parallel state. The fitting plate part 9 enters a housing of a connector of a mate side so that the housing of the connector of the mate side is fitted thereto.

In this specification, a direction parallel to a longitudinal direction of the one end part 8*a* of the terminal fitting 8 and in which the connector is fitted to the connector of the mate side is called a longitudinal direction of the fitting plate part 9 (namely, the housing 5). A direction intersecting at right angles to the longitudinal direction of the one end part 8*a* of the terminal fitting 8 (namely, the direction in which the connector is fitted to the connector of the mate side) and in which the one end parts 8*a* of the terminal fittings 8 are arranged is called a direction of width of the fitting plate part 9 (namely, the housing 5).

The partition wall part 10 is formed in the shape of a flat plate connected to one edge in the longitudinal direction of the fitting plate part 9. Both surfaces of the partition wall part 10 intersect at right angles to both the surfaces of the fitting plate part 9. Further, in this exemplary embodiment, the partition wall part 10 protrudes to an outer side of the fitting plate part 9 from the entire periphery of the one edge of the fitting plate part 9.

The shield shell 6 is obtained by applying a bending work to a thick plate, covers a periphery of the fitting plate part 9 of the housing 5 and is attached to an outer edge of the partition wall part 10. The shield shell 6 is spaced from the fitting plate part 9 of the housing 5. The shield shell 6 prevents electric noise from entering the terminal fittings 8.

The fixing members 7 are formed with a thick plate, overlaid on both side surfaces in the direction of width of the shield shell 6 and attached to the shield shell 6. Further, the fixing members 7 have protruding parts 11 (shown in FIG. 2 and FIG. 3) which are inserted into holes 12 provided on the printed circuit board 2 and electrically and mechanically connected to a ground circuit not shown in the drawing by a solder. The fixing members 7 fix the shield shell 6 (namely, the housing 5) to the printed circuit board 2.

The terminal fitting 8 is formed with electrically conductive metal and formed in the shape of a rod. In the terminal fittings 8, the one end parts 8*a* (shown in FIG. 1) are piled on both the surfaces of the fitting plate part 9 of the housing 5 under a mutually parallel state. Further, the one end parts 8*a* of the plurality of terminal fittings 8 are arranged in parallel with the surface of the substrate 3 of the printed circuit board 2 and with prescribed spaces left between them. The terminal fittings 8 have central parts 8*b* (shown in FIG. 3) passing through the partition wall part 10 and bent substantially at 90° to the printed circuit board 2. The terminal fittings 8 have tips of the other end parts 8*c* (shown in FIG. 2 and FIG. 3) provided with connecting parts 13 which are overlaid on the conductor pattern 4 of the printed circuit board 2 and connected to the conductor pattern 4 by the solder. A longitudinal direction of the connecting parts 13 is parallel to the longitudinal direction of the one end parts 8*a*.

Figure 4:
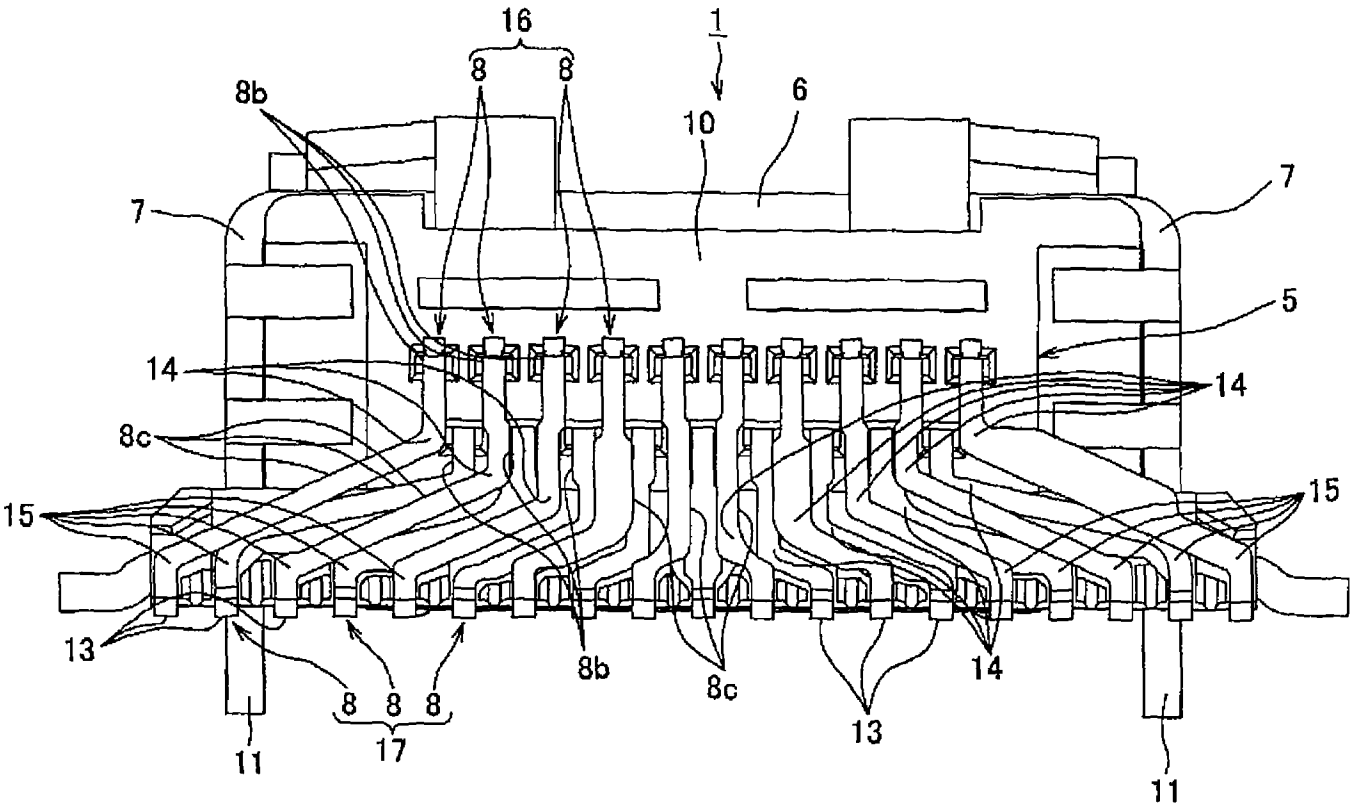
FIG. 4 is a rear view of the connector shown in FIG. 1.

As shown in FIG. 4, the other end parts 8*c* of the plurality of terminal fittings 8 are provided with outward bent parts 14 and vertically bent parts 15. The outward bent parts 14 are provided nearer to the central parts 8*b* of the terminal fittings 8 than the vertically bent parts 15. As the outward bent parts 14 go nearer to the other end parts 8*c* from the central parts 8*b*, the outward bent parts are bent more outward in the direction of width of the housing 5. In this specification, to bend outward in the direction of width of the housing 5 means to bend toward an outer surface in the direction of width of the housing 5 nearer to the other end parts 8*c* respectively of the terminal fittings 8. The vertically bent parts 15 are bent toward the printed circuit board 2 along a direction intersecting at right angles to the surface of the substrate 3 of the printed circuit board 2 as the vertically bent parts 15 go nearer to the other end parts 8*c* from the central parts 8*b*. In such a way, in the other end parts 8*c* of the terminal fittings 8, the outward bent parts 14, the vertically bent parts 15 and the connecting parts 13 are provided in order from the central parts 8*b* side thereof.

Further, the terminal fittings 8 whose one end parts 8*a* are overlaid on an upper side surface of the fitting plate part 9 in FIG. 1 among the terminal fittings 8 form a first terminal row 16 as a terminal fitting row. The terminal fittings 8 whose one end parts 8*a* are overlaid on a lower side surface of the fitting plate part 9 in FIG. 1 among the terminal fittings 8 form a second terminal row 17 as a terminal fitting row. Accordingly, it is to be understood that the first and second terminal rows 16 and 17 are provided with a plurality of terminal fittings 8. In such a way, the first and second terminal rows 16 and 17 are provided with spaces left between them along the direction intersecting at right angles (intersecting) to the surface of the substrate 3 of the printed circuit board 2.

Figure 5:
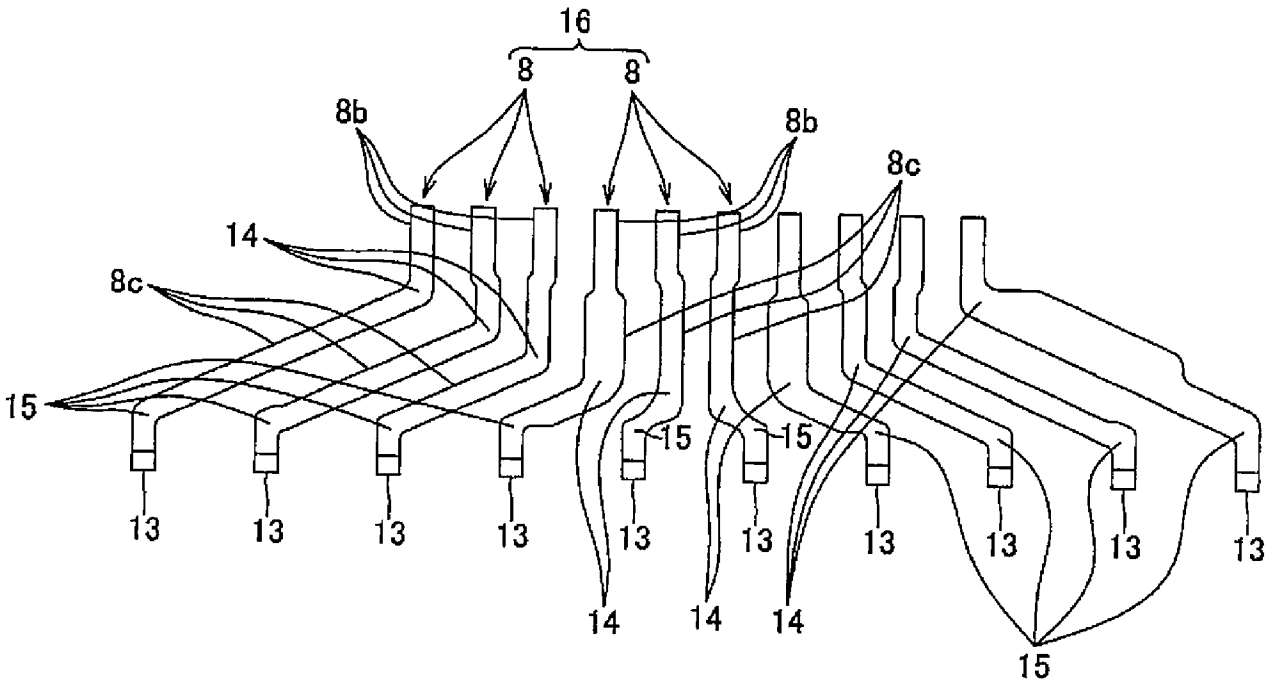
FIG. 5 is a rear view showing a positional relation of terminal fittings of first terminal rows of the connector shown in FIG. 4.

As shown in FIG. 5, in the other end parts 8*c* of the terminal fittings 8 of the first terminal row 16, bending angles of the outward bent parts 14 are mutually equal. The bending angle in this specification indicates an angle formed respectively by the parts which sandwich the outward bent part 14 between them. Further, in the other end parts 8*c* of the terminal fittings 8 of the first terminal row 16, as the outward bent parts 14 go outward in the direction of width from a center in the direction of width of the housing 5, the outward bent parts 14 are gradually provided at positions nearer to the central parts 8*b* of the terminal fittings 8. Namely, in the other end parts 8*c* of the mutually adjacent terminal fittings 8 of the first terminal row 16, the outward bent parts 14 of the terminal fittings 8 located nearer to outer sides in the direction of width of the housing 5 are provided nearer to the central parts 8*b* of the terminal fittings 8 than the outward bent parts 14 of the terminal fittings 8 located nearer to the central part in the direction of width of the housing 5.

Figure 6:
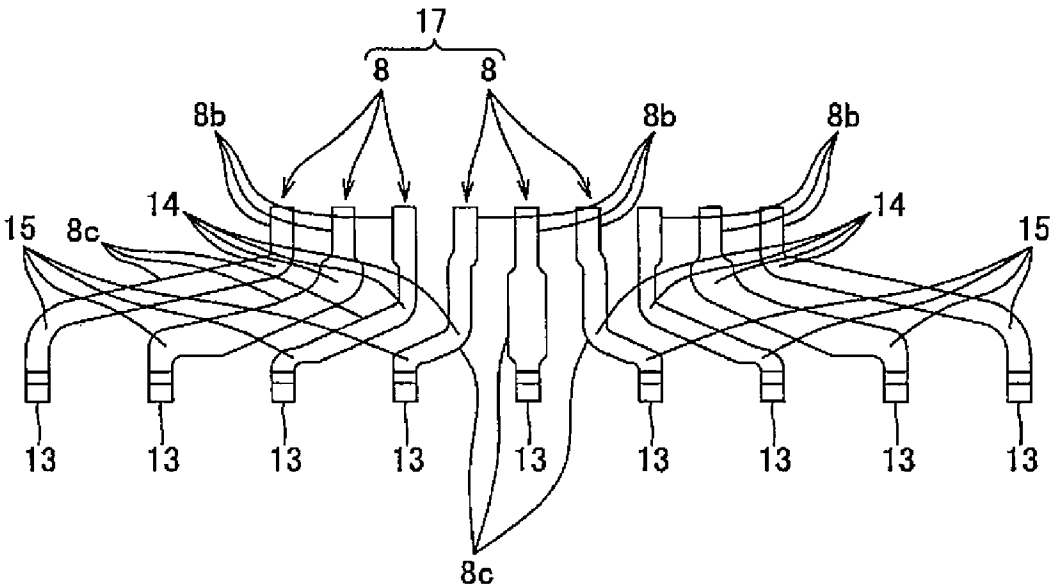
FIG. 6 is a rear view showing a positional relation of terminal fittings of second terminal rows of the connector shown in FIG. 4.

As shown in FIG. 6, the terminal fitting 8 located in the center in the direction of width of the housing 5 among the terminal fittings 8 of the second terminal row 17 is not provided with the above-described outward bent part 14 and the vertically bent part 15. In the other end parts 8*c* of the terminal fittings 8 of the second terminal row 17, as the outward bent parts 14 go outward in the direction of width from a center in the direction of width of the housing 5, the outward bent parts 14 are gradually provided at positions nearer to the central parts 8*b*. Namely, in the other end parts 8*c* of the mutually adjacent terminal fittings 8 of the second terminal row 17, the outward bent parts 14 of the terminal fittings 8 located nearer to outer sides in the direction of width of the housing 5 are provided nearer to the central parts 8*b* of the terminal fittings 8 than the outward bent parts 14 of the terminal fittings 8 located nearer to the central part in the direction of width of the housing 5.

Further, as shown in FIG. 6, in the other end parts 8*c* of the terminal fittings 8 of the second terminal row 17, as the outward bent parts 14 go outward in the direction of width from the center in the direction of width of the housing 5, the outward bent parts 14 are formed so that the bending angles of the outward bent parts 14 are gradually increased. Namely, in the other end parts 8*c* of the mutually adjacent terminal fittings 8 of the second terminal row 17, the bending angles of the outward bent parts 14 of the terminal fittings 8 located nearer to the outer sides in the direction of width of the housing 5 are larger than the bending angles of the outward bent parts 14 of the terminal fittings 8 located nearer to the central part in the direction of width of the housing 5.

Since the outward bent parts 14 of the other end parts 8*c* of the terminal fittings 8 of the terminal rows 16 and 17 are respectively formed as described above, as shown in FIG. 2 and FIG. 3, the connecting parts 13 provided in the tips of the other end parts 8*c* of the terminal fittings 8 of the two terminal rows 16 and 17 are respectively alternately arranged at prescribed intervals along the direction of width of the housing 5. Briefly, the outward bent parts 14 are respectively provided in the other end parts 8*c* of the terminal fittings 8 so that the connecting parts 13 of the terminal fittings 8 of the two terminal rows 16 and 17 are respectively alternately arranged with spaces left between them along the direction of width of the housing 5.

Further, since the outward bent parts 14 of the other end parts 8*c* of the terminal fittings 8 of the terminal rows 16 and 17 are respectively formed as described above, as shown in FIG. 2 and FIG. 4, the connecting parts 13 provided in the tips of the other end parts 8*c* of the terminal fittings 8 of all the terminal rows 16 and 17 are arranged with spaces left between them along the direction of width of the housing 5. Briefly, the outward bent parts 14 are respectively provided in the other end parts 8*c* of the terminal fittings 8 so that the connecting parts 13 of the terminal fittings 8 of all the terminal rows 16 and 17 are respectively arranged with spaces left between them along the direction of width of the housing 5. Namely, in the connector 1 of the present exemplary embodiment, the connecting parts 13 provided in the other end parts 8*c* of the plurality of terminal fittings 8 are arranged at prescribed intervals along the direction of width of the housing 5.

In the connector 1 having the above-described structure, one part of the terminal fittings 8 among the terminal fittings 8 forms one of a pair of terminal fittings as a differential pair for transmitting a high speed digital signal, the other part of the terminal fittings 8 forms the other of the pair of terminal fittings as the above-described differential pair and the remaining terminal fittings 8 form the terminal fittings for grounding connected to a ground circuit and are used to transmit the high speed digital signal.

According to the present exemplary embodiment, in the other end parts 8*c* of the terminal fittings 8, the outward bent parts 14 are provided which are bent outward in the direction of width of the housing 5. Thus, spaces between the other end parts 8*c* of the mutually adjacent terminal fittings 8 can be made to be larger than spaces between the one end parts 8*a* of the mutually adjacent terminal fittings 8. Namely, the spaces between the one end parts 8*a* of the mutually adjacent terminal fittings 8 can be made to be narrower than the spaces between the other end parts 8*c* of the mutually adjacent terminal fittings 8. Accordingly, the width of the housing 5 (namely, the connector 1 itself) can be miniaturized.

Further, the tip ends of the other end parts 8*c* of the terminal fittings 8 are arranged in the direction of width of the housing 5. Thus, the connecting parts 13 provided in the tip ends of the other end parts 8*c* of the terminal fittings 8 are not arranged along the longitudinal directions of the one end parts 8*a* of the terminal fittings 8. Therefore, the connecting parts 13 provided in the tip ends of the other end parts 8*c* of the terminal fittings 8 can be easily connected to the conductor pattern 4 of the printed circuit board 2 by the solder.

Accordingly, the connector can be miniaturized and easily attached to the printed circuit board.

Further, the tip ends of the other end parts 8*c* of all (namely, the two terminal rows 16 and 17) the terminal fittings 8 are arranged in the direction of width of the housing 5. Thus, the connecting parts 13 provided in the tip ends of the other end parts 8*c* of the terminal fittings 8 are not arranged along the longitudinal directions of the one end parts 8*a* of the terminal fittings 8. Therefore, the connecting parts 13 provided in the tip ends of the other end parts 8*c* of the terminal fittings 8 can be easily connected to the conductor pattern 4 of the printed circuit board 2 by the solder.

The outward bent parts 14 of the terminal fittings 8 located nearer to the outer sides in the direction of width of the housing 5 are provided nearer to the central parts 8*b* of the terminal fittings 8 than the outward bent parts 14 of the terminal fittings 8 located nearer to the central part in the direction of width of the housing 5. Thus, the connecting parts 13 provided in the tip ends of the other end parts 8*c* of the terminal fittings 8 located nearer to the outer sides are located more outward in the direction of width of the housing 5. Accordingly, the other end parts 8*c* of the terminal fittings 8 are not allowed to come into mutual contact and the spaces between the one end parts 8*a* of the mutually adjacent terminal fittings 8 can be made to be narrower than the spaces between the other end parts 8*c* of the mutually adjacent terminal fittings 8. Accordingly, the width of the housing 5 (namely, the connector 1 itself) can be miniaturized.

The bending angles of the outward bent parts 14 of the terminal fittings 8 located nearer to the outer sides in the direction of width of the housing 5 are larger than the bending angles of the outward bent parts 14 of the terminal fittings 8 located nearer to the central part in the direction of width of the housing 5. Thus, the connecting parts 13 provided in the tip ends of the other end parts 8*c* of the terminal fittings 8 located nearer to the outer sides are located more outward in the direction of width of the housing 5. Accordingly, the other end parts 8*c* of the terminal fittings 8 are not allowed to come into mutual contact and the spaces between the one end parts 8*a* of the mutually adjacent terminal fittings 8 can be made to be narrower than the spaces between the other end parts 8*c* of the mutually adjacent terminal fittings 8. Accordingly, the width of the housing 5 (namely, the connector 1 itself) can be miniaturized.

In the above-described exemplary embodiment, the fitting plate part 9 as the fitted part is formed in the shape of a flat plate, however, in the present invention, the fitted part may be formed in the shape of a tube. In this case, the one end parts 8*a* of the terminal fittings 8 are located in the fitted part and piled with a space left from a wall surface forming the fitted part. Further, the connector 1 of the present invention does not need to be provided with the shield shell 6.

Further, in the above-described exemplary embodiment, the two terminal rows 16 and 17 are provided, however, the present invention is not limited thereto and one or three or more terminal rows 16 and 17 may be provided. Further, the connector 1 of the present invention may be employed in other use than a use for transmitting the high speed digital signal. Further, in the present invention, the outward bent parts 14 do not necessarily need to be provided in all the terminal fittings 8. Briefly, in the present invention, as long as the connecting parts 13 provided in the tip ends of the other end parts 8*c* are arranged in the direction of width of the housing 5, the outward bent parts may be provided in at least one or more terminal fittings 8.

The above-described exemplary embodiment merely shows a representative form of the present invention and the present invention is not limited to the exemplary embodiment. Namely, the present invention may be variously modified and embodied within a scope that does not deviate from the gist of the present invention. This application is based on Japanese Patent Application (JPA. No. 2010-198068) filed Sep. 3, 2010 and its contents are incorporated herein as a reference.

INDUSTRIAL APPLICABILITY

As described above, in the connector according to the present invention, the connector can be provided which can be miniaturized and easily attached to the printed circuit board.

DESCRIPTION OF REFERENCE NUMERALS AND SIGNS

1 . . . connector
2 . . . printed circuit board
4 . . . conductor pattern
5 . . . housing
8 . . . terminal fitting
8*a* . . . one end part
8*b* . . . central part
8*c* . . . the other end part
9 . . . fitting plate part (fitted part)
14 . . . outward bent part
16 . . . first terminal row (terminal fitting row)
17 . . . second terminal row (terminal fitting row)

The invention claimed is:

1. A connector including:

a housing attached to a printed circuit board; and two terminal fitting rows, each terminal fitting row having a plurality of terminal fittings whose one end parts are piled in a fitted part of the housing to which a mate side connector is fitted in a mutually parallel state and arranged in parallel with a surface of the printed circuit board, whose central parts are bent and whose the other end parts are connected to a conductor pattern of the printed circuit board, wherein in the other end part of at least one terminal fitting of the plurality of terminal fittings in each terminal fitting row, an outward bent part bent outward in a direction of width of the housing is provided, and the outward bent parts are provided in the other end parts of the terminal fittings so that tip ends of the other end parts of the plurality of terminal fittings in the two terminal fitting rows are alternately arranged in a line with spaces left between them along the direction of width of the housing.

2. The connector according to claim 1, wherein the two terminal fitting rows are provided with spaces left between them in the direction intersecting the surface of the printed circuit board.

3. The connector according to claim 1, wherein the outward bent parts of the terminal fittings located nearer to outer sides in the direction of width of the housing are provided nearer to the central parts of the terminal fittings than the outward bent parts of the terminal fittings located nearer to a central part in the direction of width of the housing among the plurality of terminal fittings in the terminal fitting rows.

4. The connector according to claim 1, wherein bending angles of the outward bent parts of the terminal fittings located nearer to outer sides in the direction of width of the housing are larger than bending angles of the outward bent parts of the terminal fittings located nearer to the central part in the direction of width of the housing among the plurality of terminal fittings in the terminal fitting rows.

5. The connector according to claim 1, wherein the tip ends of the other end parts are provided with connecting parts to be connected to the conductor pattern, wherein a longitudinal direction of the connecting parts is parallel to a longitudinal direction of the one end parts.

* * * * *